US006231001B1

(12) United States Patent
Kramer et al.

(10) Patent No.: US 6,231,001 B1
(45) Date of Patent: May 15, 2001

(54) NOZZLE ARRAY FOR LEVITATIONAL GUIDANCE OF WEB MATERIAL

(75) Inventors: Carl Kramer, Aachen (DE); Eckehard Fiedler, Vaals (NL)

(73) Assignee: Ingenieurgemeinschaft WSP, Prof. Dr.-Ing. C. Kramer, Prof. Dipl.-Ing. H. J. Gerhardt M. S., Aachen (DE)

( * ) Notice: Subject to any disclaimer, the term of this patent is extended or adjusted under 35 U.S.C. 154(b) by 0 days.

(21) Appl. No.: 09/394,139

(22) Filed: Sep. 10, 1999

(51) Int. Cl.[7] ..... B65H 23/24; F26B 13/06
(52) U.S. Cl. ..... 242/615.11; 34/643
(58) Field of Search ..... 242/615.11; 226/973; 34/629, 636, 638, 639, 643

(56) References Cited

U.S. PATENT DOCUMENTS

| | | | | |
|---|---|---|---|---|
| 3,638,330 | | 2/1972 | Stout . | |
| 3,662,476 | * | 5/1972 | Capizzi | 34/643 |
| 3,672,066 | | 6/1972 | Stephansen . | |
| 4,455,136 | * | 6/1984 | Imose et al. | 34/643 X |
| 4,501,553 | * | 2/1985 | Imose et al. | 34/643 X |
| 5,150,534 | | 9/1992 | Kramer . | |

FOREIGN PATENT DOCUMENTS

| | | |
|---|---|---|
| 11 43 474 | 2/1963 | (DE) . |
| 30 26 132 | 2/1982 | (DE) . |
| 40 10 280 | 10/1991 | (DE) . |

* cited by examiner

*Primary Examiner*—Michael R. Mansen
(74) *Attorney, Agent, or Firm*—Renner, Otto, Boisselle & Sklar LLP

(57) ABSTRACT

A nozzle array for levitational guidance of web material. The nozzle array includes a sequence of nozzle areas in the transport direction of the web which are peripherally encompassed at least in part by fanned jets and their width varies in the direction transversely to the web transport direction. The nozzle areas may be equipped with orifice nozzles. Located between the nozzle areas are return flow zones which may be configured as return flow passageways open towards the web, whereby their cross-section is flared in the direction of the edges of the nozzle array. The nozzle areas may be v-shaped relative to their longitudinal axis oriented in the transport direction of the web. Clusters of nozzle areas may be arranged juxtaposed as viewed in the web transport direction.

7 Claims, 4 Drawing Sheets

Levitation nozzle comprising nozzle ribs of constant width
CP-max = 0.31

Levitation nozzle array in accordance with the invitation, W=15°
CP-max = 0.62

Levitation nozzle array in accordance with the invention, W=72°
CP-max = 0.62

Levitation nozzle array in accordance with the invention, W=45°
CP-max = 0.68

NOZZLE ARRAY FOR LEVITATIONAL GUIDANCE OF WEB MATERIAL

BACKGROUND OF THE INVENTION

1. Field of the Invention

The invention relates to a nozzle array for levitationally guiding and stabilizing web material for the purpose of contact-free heat transfer or drying, comprising a sequence of nozzle areas arranged in the transport direction of the web on at least one side of the web to be levitationally guided, the nozzle area including orifice nozzles or slotted nozzles.

Apparatuses for levitational guidance of web or strip material find many and varied applications in production technology. In textile production, webs of fabric are levitationally guided after printing. In drying plant, apparatuses for levitational strip guidance are employed downstream of painting systems in which both sides of the strip are painted or coated at the same time. In metalwork, levitational guidance of strips of sheet metal is employed in annealing when these need to be heat-treated on the fly without contact and with minimum stress.

2. Description of the Prior Art

Typical apparatuses of this kind are known from German disclosures DE-OS 25 56 442, DE-OS 30 26 132, DE-AS 14 74 239 and DE-OS 35 05 256. Common to all of these apparatuses is that nozzle ribs are arranged above and below the web transversely to the transport direction of the material which is guided horizontally as a rule. Located between these banks, by which levitational guidance is achieved by the corresponding flow forces, are the return flow surface areas for down flow of the gas blast jetted from the nozzle ribs against the web for levitational guidance thereof. In all of these apparatuses levitational guidance is accompanied by convective heat transfer for heating or cooling the levitationally guided web.

One such apparatus as known from German disclosure DE-OS 30 26 132, having a plurality of nozzle banks, is not only complicated in fabrication, but also has the functional disadvantage that the levitational force may be applied to the web only in the region of the projection of each nozzle rib and the space between the nozzle ribs needs to remain for the return flow. If the width to distribution ratio of the nozzle ribs is increased when a heavy web needs to be handled or in the case of the web needing to be supported at high temperatures and thus low gas density, then only a minor space remains available between the nozzle ribs for the return flow of the jetted gas. A likewise correspondingly larger proportion of the increase in pressure achieved by the fan circulating the gas in the apparatus is used up simply for the return flow.

This effect is particularly of disadvantage in an apparatus such as that disclosed by DE-OS 40 10 280 in which the return flow can only take place between the nozzle ribs. Increasing the flow rate jetted to the web which is to be levitationally guided fails namely to produce a corresponding increase in the supporting force, since at the same time the flow velocity needs to be increased in the restricted return flow cross-section, as a result of which the drop in pressure is increased in the region of the projection of return flow cross-sections at the web due to convective acceleration being likewise increased, i.e. although a larger overpressure is built up in the region of the nozzle ribs, at the same time, however, the vacuum pressure in the region of the return flow surface area is increased so that, in all, no substantial boost actually takes place.

The big disadvantage of existing apparatuses employing nozzle ribs and return flow surface areas between the nozzle banks for levitational guidance of wide webs becomes particularly evident when it is realized that for levitational guidance of a horizontal web an overpressure needs to be built up underneath the web, which on average corresponds to the unit weight of the web to be supported, i.e. a heavy web requires a correspondingly higher overpressure. Levitational guidance means that the web needs to be distanced away from the nozzle array located under the web, a volume thus materializing under the web which is formed by the surface area of the web and the distancing of the web from the nozzle array. The side surface areas of this volume are not restricted, i.e. the gas building up an overpressure under the web is able to flow from these side surface areas at a velocity corresponding to the overpressure relative to the environment. Thus, this lateral down flow will always materialize when the web is to be supported at a considerable distance away from the nozzle array. This considerable distance is, however, necessary when e.g. the material is a semi-finished strip of sheet-metal which deforms when exposed to the heat transfer occurring in levitational guidance, in this case spaces of 100 mm and more between the strip and nozzle array are needed. Achieving such a spacing in the case of heavy strips or webs is not possible with any of the apparatuses previously cited.

SUMMARY OF THE INVENTION

It is thus the object of the present invention to provide a levitation nozzle array, with which wide as well as heavy webs may be levitationally guided and which obviates the disadvantages as cited above.

This object is achieved in a nozzle array for levitationally guiding and stabilizing web material, for the purpose of contact-free heat transfer or drying comprising a sequence of nozzle areas arranged in the transport direction of the web on at least one side of said web to be levitationally guided, said nozzle area including orifice nozzles or slotted nozzles, wherein the width of said nozzle area, as measured parallel to said transport direction of the web, varies over said width of said nozzle array as measured perpendicular to said transport direction of the web, and said nozzle areas are peripherally encompassed at least in part by slotted nozzles.

Preferred embodiments are defined by the features as they read from the sub-claims.

In the levitation nozzle array in accordance with the invention instead of the usual nozzle ribs equal in width over the full web, nozzle areas are employed, the width of which changes transversely to the transport direction of the web, e.g. diminishing from the middle of the web outwardly. In this embodiment, open return flow passageways materialize towards the web, the width of which increases from the middle to the edges of the web and by means of which the gas jetted onto the web is able to flow off therefrom laterally. The feed flow to the nozzle areas is made by a duct located on the side of the nozzle areas facing away from the web and which is fed with the jetting gas either from one end or both ends.

BRIEF DESCRIPTION OF THE DRAWINGS

The invention will now be detailed by way of an example of a levitation nozzle array for an oven for the heat-treatment of relatively heavy strips of metal, e.g. of copper or copper alloys, the drawings assisting in explaining the description, in which FIGS. 1A-1 and 1A-2 respectively are an side elevational view and a plan view of a levitation nozzle array formed by a prior art arrangement of nozzle ribs, FIGS. 1B-1 and 1B-2 respectively are a side elevational view and a plan view of one embodiment of levitation nozzle array according to the invention, FIGS. 1C-1 and 1C-2 respectively are a side elevational view and a plan view of another embodiment of levitation nozzle array according to the invention, FIGS. 1D-1 and 1D-2 respectively are a side elevational view and a plan view of a further embodiment of levitation nozzle array according to the invention.

DESCRIPTION OF THE PREFERRED EMBODIMENTS

Figures 1, 1A:
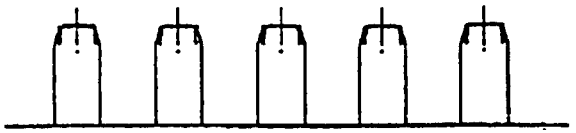
FIG. 1A-1 PRIOR ART
Figures 1, 1A, 2:
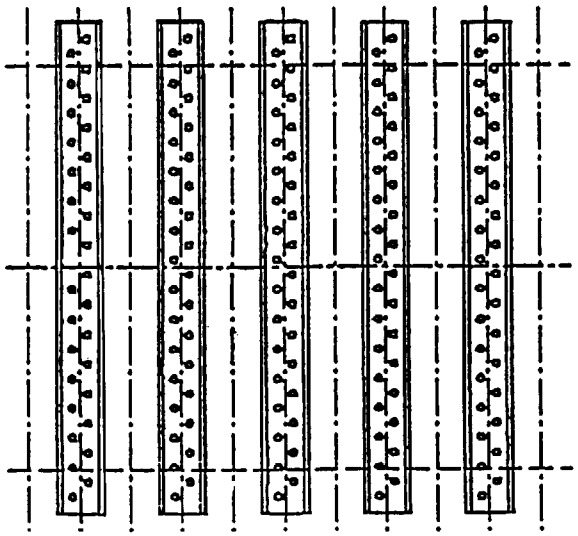
FIG. 1A-2 PRIOR ART
FIG. 2 is a perspective view of the levitation nozzle array in accordance with the invention, comprising nozzle areas corresponding to the middle section of a double truncated cone incorporating the essential elements for correspondingly guiding the flow.
Figures 1, 1B:
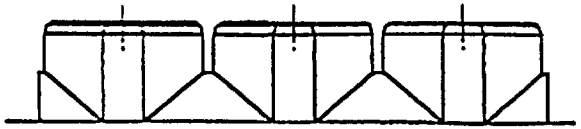
Figures 1, 1B, 2:
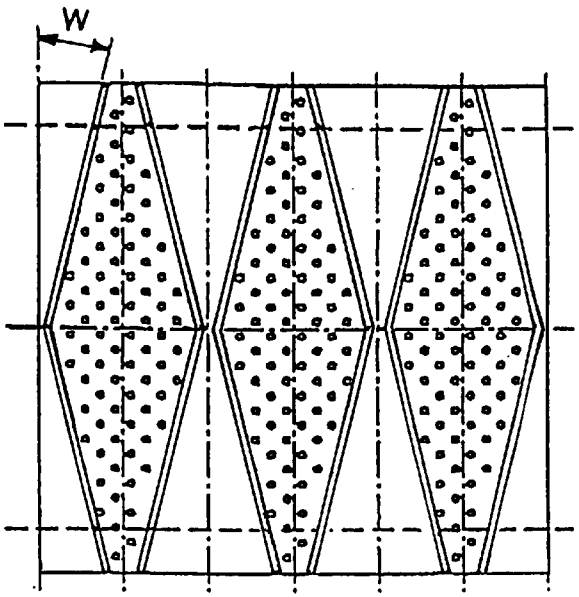
Figures 1, 1C:
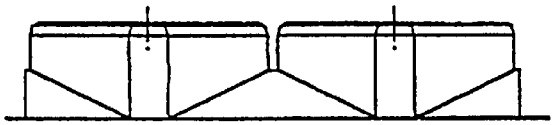
Figures 1, 1C, 2:
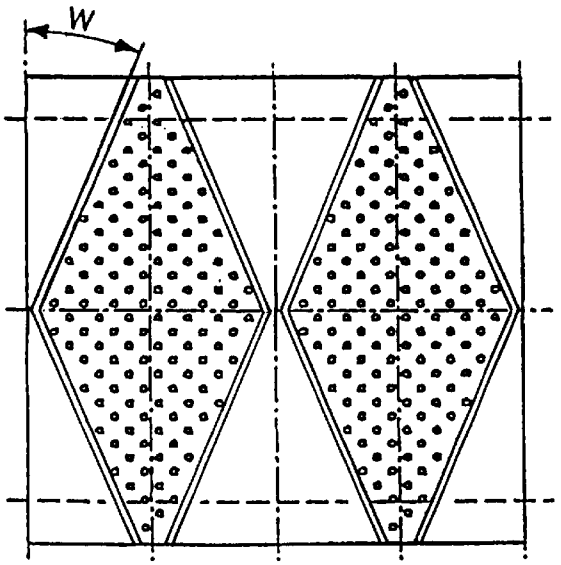
Figures 1, 1D:
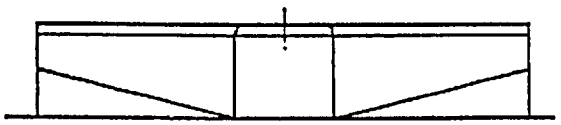
Figures 1, 1D, 2:
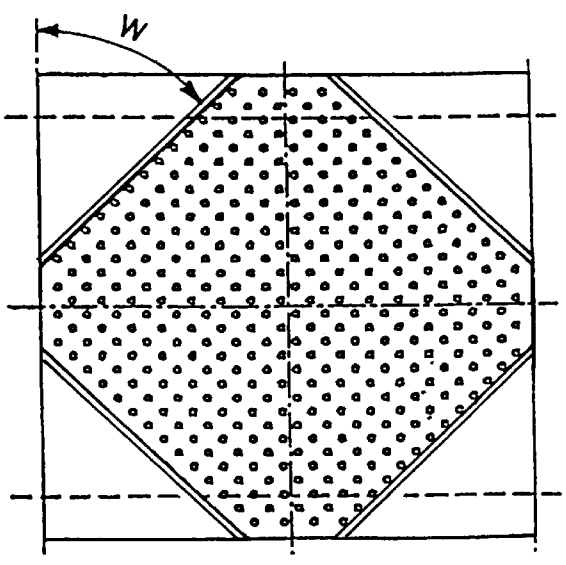
Figure 2:
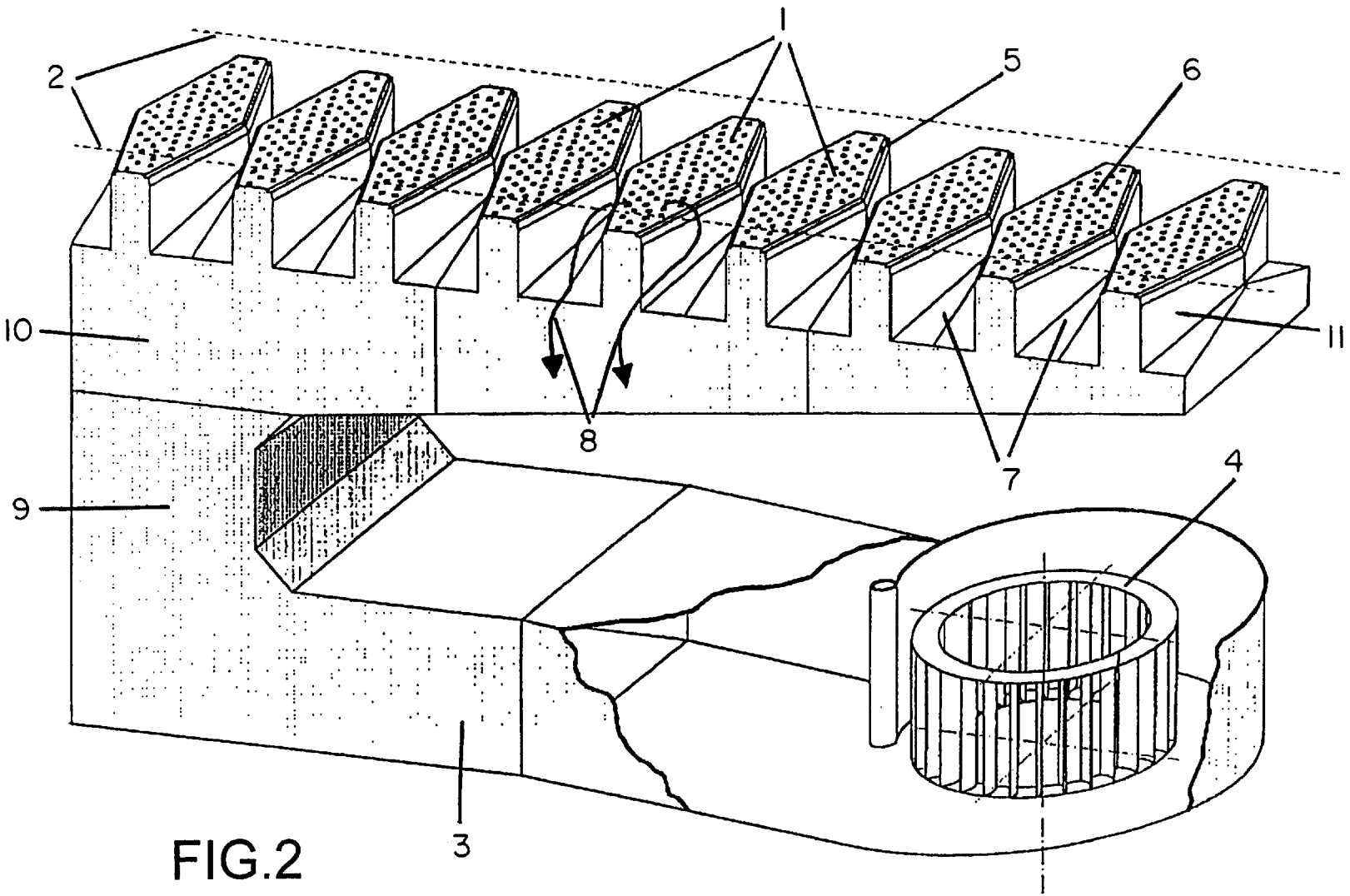

FIGS. 1A-1 and 1A-2 illustrate at the top left a prior art levitation nozzle array comprising nozzle ribs, the width of which do not change with the width of the web, compared to the nozzle array in various embodiments in accordance with the invention as shown in FIGS. 1B-1, 1B-2, 1C-1, 1C-2, 1D-1 and 1D-2, i.e. three embodiments of the nozzle areas in accordance with the invention which, compared to the nozzle banks of constant width in prior art, are splayed in the middle so that the nozzle areas of this levitation nozzle array are widest in the middle and diminish linearly to the smallest width at the edges which may roughly correspond to the usual constant width.

The three embodiments merely differ by their "splay angle" W, namely the angle made by the perpendicular on the center line of the levitation nozzle array to the longitudinal edge of each nozzle area. In the levitation nozzle arrays in accordance with the invention, this angle W varies from 15; (FIGS. 1B-1 and 1B-2) via 22; (FIGS. 1C-1 and 1C-2) to 45; (FIGS. 10-1 and 10-2), resulting in, basically, a square nozzle area in which two corners are located on the longitudinal edges of the levitation nozzle array.

It is the value $c_{p\ max}$ which serves to characterize the supporting force, this being the pressure corresponding to the unit weight of the web to be levitationally guided relative to the back pressure in the orifices of the levitation nozzles resulting as a maximum, i.e. at minimum spacing between web and nozzle area. The $c_{p\ max}$ value depends on the ratio of the nozzle area to the complete jetted surface area of the web.

In a levitation nozzle array comprising nozzle ribs of constant width, this value amounts to 0.31. In the various embodiments of the nozzle array in accordance with this invention the value ranges from 0.62 to 0.68 depending on how the nozzle area (angle W) is shaped. This comparison already shows that substantially larger unit weights may be supported without difficulty under the same conditions by the nozzle array in accordance with this invention compared to standard nozzle arrays incorporating nozzle ribs.

The physics forming the reason for this is as follows: firstly, the down flow passageways between the nozzle areas are flared from the middle of the web to the edge thereof so that the return flow surface area like the return flow rate increases from the middle of the web to the edge thereof. As a result of this, a larger proportion of the nozzle area may be accommodated in the middle of the nozzle array than in the edge portions of the nozzle array. Secondly, the slotted nozzles arranged at the edges of the nozzle areas, as shaped in accordance with the invention, result in a velocity component and a corresponding pulsed force component from the edge of the web to the middle thereof, thus, obstructing the down flow from the overpressure portion between web and nozzle area. This obstruction leads to an increase in the static pressure between nozzle area and web and thus to an increase in the supporting force.

As is evident from the embodiments as shown in FIGS. 1B-1, 1B-2, 1C-1, 1C-2, 1D-1 and 1D-2, round orifice nozzles are arranged between the slotted nozzles on the nozzle area to improve heat transfer. Since, given the same proportional overall nozzle area, the proportion of overall nozzle area taken up by the slotted nozzles in a usual levitational nozzle system incorporating conventional nozzle ribs (FIGS. 1A-1 and 1A-2) is greater than in the nozzle array according to the invention, the nozzle array according to the invention provides more nozzle area for the orifice nozzles. The orifice nozzles achieve, however, a higher heat transfer than slotted nozzles, therefore, nozzle arrays in accordance with the invention are also superior in this respect to conventional levitation nozzle systems.

Where specific requirements exist, e.g. in the case of a very wide systems, levitation nozzle areas varying in width transversely to the run of the web may also be arranged juxtaposed transversely to the transport direction of the material so that return flow zones for the flow rate jetted onto the web materialize between these surface areas. From these return flow zones, the return flow may be discharged through passageways passing through the manifold supplying the nozzle array. FIG. 2 illustrates in perspective a levitation nozzle array 1 in accordance with the invention. For the sake of an uncluttered representation only half of the nozzle array 1 and the associated flow supply 3, namely a manifold 3 with a radial fan 4 is shown. The edges of the web 2 are indicated by broken lines 2. If jetting of the web 2 is provided on both sides, a second means of this kind would be arranged above the web 2, i.e. mirror-inverse to the web 2. However, it is also possible to arrange the nozzle array on one side only, i.e. only underneath the web 2 when guided horizontally.

In addition to the flow supply shown in FIG. 2 with a radial fan 4, the axis of which stands perpendicular to the web 2, other ducts may, of course, be provided to supply the nozzle array 1 with the jetting gas for the web 2.

The actual levitation nozzle array is formed by several nozzle areas 1 rowed in sequence behind each other in the transport direction of the web which are connected via individual flow chambers 11, a plenum 10 and an adapter 9 to the manifold 3 with the radial fan 4. The flow chambers 11 are provided at their upper surface area facing the web 2 with nozzle areas 1 which viewed from above have the form of the nozzle areas 1 as shown in FIGS. 1B-2, 1C-2, and 1D-2.

In the embodiment as shown the plenum 10 is fed from one end, however, it is also possible to feed it from both ends or via a central feeder.

The nozzle areas 1 of this levitation nozzle array are encompassed almost completely by slotted nozzles 5. It is only at the truncated end regions running parallel to the edges 2 of the web that no slotted nozzles 5 are provided.

These slotted nozzles 5 orient fanned jets against the web, each of which is inclined towards the middle of each nozzle area 1, as a result of which the slotted nozzles 5 encompassing one and the same nozzle area 1 are inclined with respect to each other. The nozzle area 1 itself is equipped with orifice nozzles 6. Materializing between the individual nozzle areas 1 or nozzle chambers 11 are passageways 7 serving to deflect the down flow of the gas blast jetted by the nozzle array 1 to the web 2 to the side of the system. These passageways 7 are flared from the middle of the web to the edge thereof in its extent in the transport direction of the material due to the shape of the nozzle arrays 1 At the same time the height of the passageway cross-section perpendicular to the plane of the web, as viewed from the middle of the nozzle array to its edge, increases since the plenum 10 has a kind of gable roof. The down flow, indicated by the flow arrow 8, is directed to the sides of the apparatus and gains access via the ducting 10, 9, 3 supplying the nozzle array 1 to the intake zone of the radial fan 4 which supplies the nozzle array 1 with jetting gas.

Figure 3:
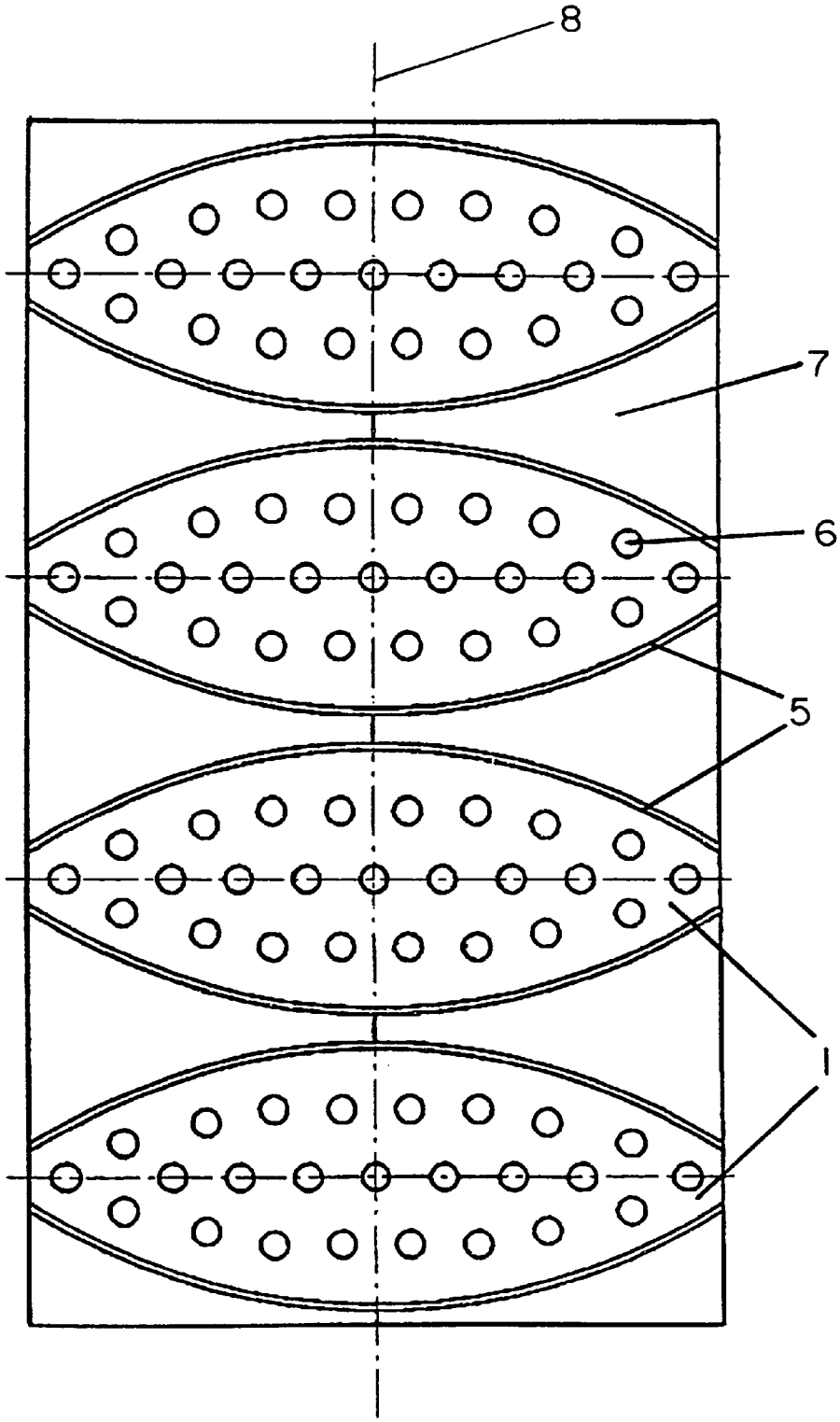
FIG. 3 is a plan view depicting another embodiment of the levitation nozzle array in accordance with the invention.

FIG. 3 illustrates in a diagrammatic plan view yet another embodiment of the levitation nozzle array in accordance with the invention. In this case, the slotted nozzles 5 encompassing almost completely the nozzle areas 1 have the shape of a cross-section of a barrel, i.e. are round, the largest diameter of the barrel being likewise located in the middle of the apparatus. The width of the return flow passageways 7 thus increases more than linearly from the middle of the system to the edges thereof. In addition, as shown in FIG. 3, the nozzle areas 1 can be viewed as having the shape of a double truncated cone formed with convexly curved leading and trailing edges along the web path instead of the straight edges shown in FIG. 2.

In order to equalize the supporting force response for webs of various widths and, thus, the heat transfer over the width of the web, the nozzle slots 5, encompassing the nozzle areas 1 at least in part around their periphery, may also be configured with a width which varies along the longitudinal extent of the nozzle slots 5.

Yet a further means of adapting the levitation response is possible by configuring the nozzle areas 1 v-shaped relative to the longitudinal axis of the levitation nozzle array, whereby the v-shape may be oriented in the direction of as well as away from the web.

While the generic term "web" has been used herein, it will be appreciated that such a term in not limited to any particular material, as the invention may be just as useful with all web or strip material including that of paper, textile, metal foil, synthetic plastics and the like.

What is claimed is:

1. A nozzle array for levitationally guiding and stabilizing web material along a web path, for the purpose of contact-free heat transfer or drying, comprising a sequence of nozzle areas arranged in the transport direction of the web on at least one side of said web path, said nozzle areas each including leading and trailing slot nozzles and orifice nozzles located between the leading and trailing slot nozzles along said transport direction of the web, and wherein the width of each said nozzle area, as measured parallel to said transport direction of the web, diminishes from the center of said nozzle area toward its lateral edges.

2. The levitation nozzle array as set forth in claim 1, wherein said nozzle areas each have opposite side portions extending from the center of the nozzle area towards its lateral edges, and said side portions, and said side portions have a truncated cone shape with the base of the cone disposed at the center of the respective nozzle area.

3. An apparatus as set forth in claim 1, wherein the jets emerging from said leading and trailing slot nozzles are inclined with respect to one another towards the middle of said nozzle area.

4. The apparatus as set forth in claim 1, wherein said nozzle areas are disposed at the ends of respective supply chambers, relatively adjacent supply chambers define therebetween passageways, and the axial cross-section of said passageways is flared from the middle of said levitation nozzle array towards the edges thereof.

5. The apparatus as set forth in claim 4, wherein said flared passageways also increase in depth as measured perpendicular to web path going from the middle of said levitation nozzle array towards the edges thereof.

6. The apparatus as set forth in claim 1, wherein said nozzle areas each have opposite side portions extending from the center of the nozzle area towards its lateral edges, and said side portions slope away from the web path going from the center of the nozzle area to the respective lateral edge of the nozzle area.

7. The apparatus as set forth in claim 1, wherein clusters of nozzle areas are arranged juxtaposed as viewed in said web transport direction.

* * * * *